US006428002B1

(12) United States Patent
Baranauskas

(10) Patent No.: US 6,428,002 B1
(45) Date of Patent: Aug. 6, 2002

(54) METHOD AND APPARATUS FOR PLAYING A WAGERING GAME

(76) Inventor: Alfons V. Baranauskas, 9956 Johnny Cake Rd., Unit M-10, Concord, OH (US) 44077

( * ) Notice: Subject to any disclaimer, the term of this patent is extended or adjusted under 35 U.S.C. 154(b) by 0 days.

(21) Appl. No.: 09/522,050

(22) Filed: Mar. 9, 2000

Related U.S. Application Data

(60) Provisional application No. 60/123,462, filed on Mar. 9, 1999, provisional application No. 60/123,460, filed on Mar. 9, 1999, provisional application No. 60/123,478, filed on Mar. 9, 1999, provisional application No. 60/123,466, filed on Mar. 9, 1999, provisional application No. 60/131,032, filed on Apr. 26, 1999, and provisional application No. 60/123,467, filed on Mar. 9, 1999.

(51) Int. Cl.[7] ..... A63F 3/00

(52) U.S. Cl. ..... 273/236; 273/292; 273/274; 273/309

(58) Field of Search ..... 273/292, 274, 273/309, 306, 303, 138 R; 463/13, 26, 27

(56) References Cited

U.S. PATENT DOCUMENTS

| | | | | |
|---|---|---|---|---|
| 3,667,757 A | * | 6/1972 | Holmberg | 273/135 G |
| 4,817,528 A | * | 4/1989 | Baker | 101/395 |
| 5,072,946 A | | 12/1991 | Miller | |
| 5,073,930 A | | 12/1991 | Green et al. | |
| 5,098,107 A | * | 3/1992 | Boylan et al. | 273/292 |
| 5,112,059 A | * | 5/1992 | Mundle et al. | 273/292 |

(List continued on next page.)

OTHER PUBLICATIONS

Alfons V. Baranauskas; Triptease; Mar. 9, 1998 (effective date of copyright registration); TXu 843–395.
Alfons V. Baranauskas: Forty–Niner; Mar. 9, 1998 (effective date of copyright registration); TXu 843–393.
Alfons V. Baranauskas; Wagering Card Game; Mar. 9, 1998 (effective date of copyright registration); TXu 843–411.
Alfons V. Baranauskas; On the Money; Mar. 9, 1998 (effective date of copyright registration); TXu 848–200.

(List continued on next page.)

*Primary Examiner*—Benjamin H. Layno
*Assistant Examiner*—Dolores R. Collins
(74) *Attorney, Agent, or Firm*—Renner, Otto, Boisselle & Sklar, LLP

(57) ABSTRACT

A playing card wagering game method which involves each player placing an initial one part wager. Dealer resolves the initial wager. Players have the option to place multiple additional wagers placed in one or more Common Betting Areas unique to the present invention. A dealer deals face up cards in a customary fashion to one or more display card areas until a three of a kind match by rank occurs in the one or more areas, or until cards are consumed and the areas offer no three of a kind match by rank deeming a Tie hand. Dealer resolves all bets made in the Common Betting Areas based on which areas a three of a kind match by rank first occured.

The present invention may be played with the higher ranking portion, the portion comprising the card ranks of Nine through Ace of a standard deck of Poker playing cards or by video machine technology in a casino or home environment.

22 Claims, 7 Drawing Sheets

U.S. PATENT DOCUMENTS

| | | | | | |
|---|---|---|---|---|---|
| 5,174,579 | A | | 12/1992 | Griffiths | |
| 5,226,661 | A | | 7/1993 | Wolf | |
| 5,288,081 | A | * | 2/1994 | Breeding | 273/292 |
| 5,314,193 | A | | 5/1994 | Ferrer | |
| 5,324,041 | A | * | 6/1994 | Boylan et al. | 273/292 |
| 5,417,430 | A | * | 5/1995 | Breeding | 273/292 |
| 5,431,407 | A | * | 7/1995 | Hofberg et al. | 273/292 |
| 5,437,462 | A | * | 8/1995 | Breeding | 273/292 |
| 5,454,570 | A | * | 10/1995 | Karal | 273/292 |
| 5,496,038 | A | * | 3/1996 | Kangsanaraks | 273/292 |
| 5,529,309 | A | * | 6/1996 | Bartlett | 273/292 |
| 5,544,892 | A | * | 8/1996 | Breeding | 273/292 |
| 5,549,300 | A | * | 8/1996 | Sardarian | 273/292 |
| 5,713,573 | A | * | 2/1998 | Nazaryan | 273/292 |
| 5,713,574 | A | | 2/1998 | Hughes | |
| 5,720,484 | A | * | 2/1998 | Hsu | 273/292 |
| 5,743,530 | A | * | 4/1998 | Sklad et al. | 273/274 |
| 5,762,340 | A | * | 6/1998 | Feola | 273/292 |
| 5,772,211 | A | * | 6/1998 | Nazaryan et al. | 273/292 |
| 5,794,934 | A | * | 8/1998 | Malcolm | 273/292 |
| 5,803,809 | A | * | 9/1998 | Yoseloff | 463/13 |
| 5,813,673 | A | * | 9/1998 | Richardson | 273/292 |
| 5,845,906 | A | * | 12/1998 | Wirth | 273/274 |
| 5,845,907 | A | * | 12/1998 | Wells | 273/292 |
| 5,851,011 | A | | 12/1998 | Lott | |
| 5,895,047 | A | * | 4/1999 | Callahan | 273/292 |
| 5,911,419 | A | * | 6/1999 | Delaney et al. | 273/292 |
| 5,957,459 | A | * | 9/1999 | Chae | 273/292 |
| 5,975,529 | A | * | 11/1999 | De Keller | 273/292 |
| 5,988,643 | A | * | 11/1999 | Awada | 273/292 |
| 6,019,374 | A | * | 2/2000 | Breeding | 273/292 |
| 6,029,976 | A | * | 2/2000 | Brunelle | 273/309 |
| 6,042,118 | A | * | 3/2000 | Poitra | 273/292 |
| 6,065,753 | A | | 5/2000 | Morosky | |
| 6,070,873 | A | * | 6/2000 | Perkins | 273/292 |
| 6,073,930 | A | * | 6/2000 | Jones et al. | 273/292 |
| 6,079,713 | A | * | 6/2000 | Paz | 273/292 |
| 6,095,525 | A | * | 8/2000 | Terminel | 273/274 |
| 6,098,984 | A | * | 8/2000 | Moore, Jr. | 273/292 |
| 6,113,101 | A | * | 9/2000 | Wirth | 273/274 |
| 6,189,888 | B1 | * | 2/2001 | Brunelle | 273/292 |
| 6,196,548 | B1 | * | 3/2001 | Schaefer | 273/292 |
| 6,206,373 | B1 | * | 3/2001 | Garrod | 273/292 |
| 6,206,375 | B1 | * | 3/2001 | Wichinsky | 273/292 |
| 6,234,483 | B1 | * | 5/2001 | Bucan | 273/292 |
| 6,234,485 | B1 | * | 5/2001 | Perkins | 273/292 |
| 6,237,916 | B1 | * | 5/2001 | Webb | 273/292 |
| 6,237,917 | B1 | * | 5/2001 | Timpano | 273/292 |
| 6,241,250 | B1 | * | 6/2001 | Webb | 273/292 |
| 6,247,697 | B1 | * | 6/2001 | Jewett | 273/292 |
| 6,264,200 | B1 | * | 7/2001 | Smith | 273/274 |
| 6,273,424 | B1 | * | 8/2001 | Breeding | 273/292 |
| 6,279,910 | B1 | | 8/2001 | de Keller | |

OTHER PUBLICATIONS

Alfons V. Baranauskas; Birdie; Mar. 9, 1998 (effective date of copyright registration); TXu 843–394.

Alfons V. Baranauskas; Trio; Jul. 15, 1999 (date received by Copyright Office).

Alfons V. Baranauskas; Match; Jul. 15, 1999 (date received by Copyright Office).

Alfons V. Baranauskas; Midway; Jul. 15, 1999 (date received by Copyright Office).

Alfons V. Baranauskas; Split; Jul. 15, 1999 (date received by Copyright Office).

Alfons V. Baranauskas; Niner; Jul. 15, 1999 (date received by Copyright Office).

* cited by examiner

METHOD AND APPARATUS FOR PLAYING A WAGERING GAME

CLAIM OF PRIORITY

This application claims priority based on provisional patent applications Serial No. 60/123,462, filed Mar. 9, 1999; Serial No. 60/123,460, filed Mar. 9, 1999; Serial No. 60/123,478, filed Mar. 9, 1999; Serial No. 60/123,466, filed Mar. 9, 1999; Serial No. 60/131,032, filed Apr. 26, 1999; and Serial No. 60/123,467, filed Mar. 9, 1999. All of the aforesaid applications are hereby incorporated herein by reference.

TECHNICAL FIELD

The present invention relates to a playing card wagering game that can be played with the higher ranking portion, said portion comprising the card ranks of Nine through Ace, of a typical fifty-two card Poker deck or conglomeration of multiple said portions or by video machine technology in a casino or home environment. In particular it does relate to a method and apparatus for playing a wagering game, wherein said game is not of Pinochle origin or set with rules for typical Pinochle play and provides players with the opportunity to make a plurality of separate bets or wagers during the course of the game.

BACKGROUND

There are many wagering games used for betting or chancing. Such games should be exciting to arouse players interest and uncomplicated so they can be easily understood by a large quantity of players. Ideally the games should offer more than one wagering opportunity during the course of the game, yet be able to be played swiftly to a wager resolving outcome. Wagering games particularly those intended for play in casinos should provide players with a sense of participation and control, the opportunity to make more than one card drawing and/or wagering decision and reasonable odds of winning although the odds favor the house or bank. The game must also accommodate the requirements of regulatory agencies.

SUMMARY OF THE PRESENT INVENTION

The wagering game of the present invention may be played with the higher ranking cards or portion of a typical fifty-two card Poker deck, said portion comprising the card ranks of Nine through Ace. Card ranks of Two through Eight need not be used in the present invention. Said game does not involve the generally well recognized and accepted set of rules and procedures and hand resolving outcomes of typical Pinochle game play. The game method comprises of each player placing an initial wager (which may also be referred to herein as an initial bet) to participate in the game. The players are queried by a dealer to place their initial wagers into Common Betting Areas (CBAs) provided on the gaming table top. Players have the opportunity to place additional bets since the present invention offers players with multiple choices of separate wager opportunities for strategic game play on the basis of providing choices of, for example, Ranks, Zones and Ties wagering areas. After all players have made their additional bets, the dealer continues the hand by dealing cards in a typical fashion until a three of a kind match by rank has occurred in one or more dealer display card areas. If all distinct card positions in said areas are occupied with a card and said areas offer no three of a kind match by rank the hand is then over and declared a Tie.

If a three of a kind match by rank occurs in either a display card area before or when all display card areas are occupied with a card, the dealer would query players of said three of a kind card match by rank and the hand is considered ended. The dealer queries the players of winning bets and prepares for the payouts of said bets and the collections of the losing bets.

According to an embodiment of the present invention, the dealer uses a cup and playing dice outcome to determine first card position to allow random start of the game. Dealer pays out on the winning initial bets and collects the losing bets. Specifically, the participating players initial wager is a one part wager and is placed before the start-of-game playing die is rolled and before any cards are dealt by the dealer. Said initial wager is location restricted to only the Player-one zone wager area and to the Player-two zone wager area. Said zones are depicted by lettered words, for example, player-one zone wager area is depicted by the word "ONE" and the Player-two zone wager area is depicted by the word "TWO" in each CBA on the gaming table top. Said zones are common to the Player-one and Player-two display card areas also depicted by lettered words "ONE" and or "TWO". Participating players are not playing against each other or against the dealer, but said initial wager is based on said players forecasting and betting on exactly where the location of, regarding said display card areas, the first card will be dealt after the start-of-game cup-die is rolled. After all players have placed said initial wager, dealer rolls said typical start-of-game playing die to determine which of the two display card areas (Player-one "ONE" or Player-two "TWO") will receive the first card. Thus, for example, if the rolled die shows a number one, three or five then the Player-one display card area receives the first card dealt and if said die shows a number two, four or six then the Player-two display card area receives the first card dealt by the dealer. Dealer queries the players of the first card location and marks said location with a removable indicator apparatus. Dealer collects the losing players wagers and pays out even money (e.g., one to one, or three to one) to the winning players bets. Next the dealer queries the participating players that they can make additional bets by betting up to twenty-one separate bets in the depicted Common Betting Areas CBAs by physically placing said wagers onto the gaming table top into the depicted CBAs. Each CBA accommodates preferably two players but is not limited to said number of players. Next cards are dealt face up by the dealer to the Player-one display card areas distinct card positions and to the Player-two display card areas distinct card positions in a common typical staggered customary fashion. Said fashion is of a one for the Player-one display card area and then one for the Player-two display card area, said common method continuing until a three of a kind match by rank occurs in either the Player-one or the Player-two display card areas. Each said area comprises twelve separate and distinct card positions. Said card positions are segregated by a perforated vertical line every three card positions. Dealer continues dealing face up cards to both said areas positions only until a three of a kind match by rank occurs, leaving the remainder unused distinct card positions empty. If no three of a kind match by rank occurs, all distinct card positions in both the Player-one and Player-two display card areas will be occupied with a face up card. Said occurrence will consume a total of twenty-four face up cards and is declared a Tie hand. Dealer queries players of the winning bets and prepares for the payouts of said bets and the collections of the losing bets. Finally, the dealer resolves all bets by determining what payout, if any, each player is entitled to receive. Payouts are made to the winning hands according to a table or preselected payout schedule at that particular gaming table or casino, and the losing or non winning hands are collected by the dealer or house. Dealer collects the played or used cards and places said cards into the used card collection apparatus on the gaming table top and then prepares for the next new hand.

Apparatus is disclosed for playing the wagering game according to the method outlined above. A typical gaming table with a playing surface includes three Common Betting Areas CBAs, a Player-one display card area, a Player-two display card area, and six player positions.

In another embodiment of the present invention, the participating players initial wager is a one part wager and is placed before any cards are dealt by the dealer. Said initial wager is location restricted to only the Rank zone wager areas. Said zone wager areas are depicted by the capital lettered initials and numbers of A,K,Q,J, 10 and 9 and are area located in each of the three CBAs. Said players can place additional wagers into any of the five Zone wager areas depicted by the capital numbers of 1 through 5. Each said player can also place an additional wager into the Tie wager area depicted by the word Tie in each said CBA. Participating players are not playing against each other or against the dealer, but said initial wager is based on said players forecasting and betting on exactly what Rank regarding Ace through Nine a three of kind match by rank will occur. After all players have placed said initial wager each participating player can wager on a TIE or exactly in what Zone, for example, Zones 1,2,3,4 or 5, the said three of a kind match by rank will occur. Each said Zone comprises one two or six distinct card positions, wherein said Zone 5 comprises six said card positions, and Zones 1 and 2 comprise two card positions and Zones 3 and 4 comprise one said card position, thus having twelve total distinct card positions. Each CBA accommodates preferably two participating players but is not limited to said number of players. Next cards are dealt face up by the dealer and placed into the said distinct card positions in the dealer display card area in the customary fashion until a three of a kind match by rank occurs. Dealer only continues dealing face up cards until a three of a kind match by rank occurs thus leaving the remainder unused distinct card positions empty. Said card positions may be segregated by, for example, a perforated vertical line starting after the first six distinct card positions, said segregation occurring and continuing every one card position for two positions then every two positions thereafter. Thus, for example, if all twelve distinct card positions are occupied with a face up card and said dealer display area still offers no three of a kind match by rank then the hand is deemed a Tie. A true Tie hand consumes a total of twelve face up cards. Dealer queries players of said TIE or of a three of a kind match and collects the losing players wagers and pays out money or chips to the winning players bets. Dealer queries players of the winning bets and prepares for the payouts of said bets and the collections of the losing bets. Finally, the dealer resolves all bets by determining what payout, if any, each player is entitled to receive. Payouts are made to the winning hands according to a table or predetermined payout schedule at that particular gaming table or casino, and the losing or non winning hands are collected by the dealer or house. Dealer collects the played or used cards and places said cards into the used card collection apparatus on the gaming table top and then prepares for the next new hand.

Apparatus is disclosed for playing the wagering game according to the method outlined above. A typical gaming table with a playing surface includes specific areas that provide locations for player positions, placing of the wagers and for displaying cards.

It is an object of the present invention to provide a new approach to the wagering game industry, by detouring from the typical Poker game variations such as Five and Seven Card Stud.

It is an object of the present invention to provide a card game that is based on plural wagering decisions. It is another aim of the present invention to provide the opportunity for players to make many decisions by giving said players the chance to make plural wagers or bets per hand.

It is yet another object of the present invention to provide a unique and exciting card game for play in casinos or at home on various media including casino tables and or video machines.

It is an advantage of the game of the present invention that multiple wagering decisions are inherent to the game. The game enhances the players sense of participation and takes advantage of players inclination to make more than one wager decision, thereby providing an opportunity for the house to gain or profit due to player error.

DESCRIPTION OF THE DIAGRAMS

DETAILED DESCRIPTION OF THE PREFERRED EMBODIMENT

Figure 1:
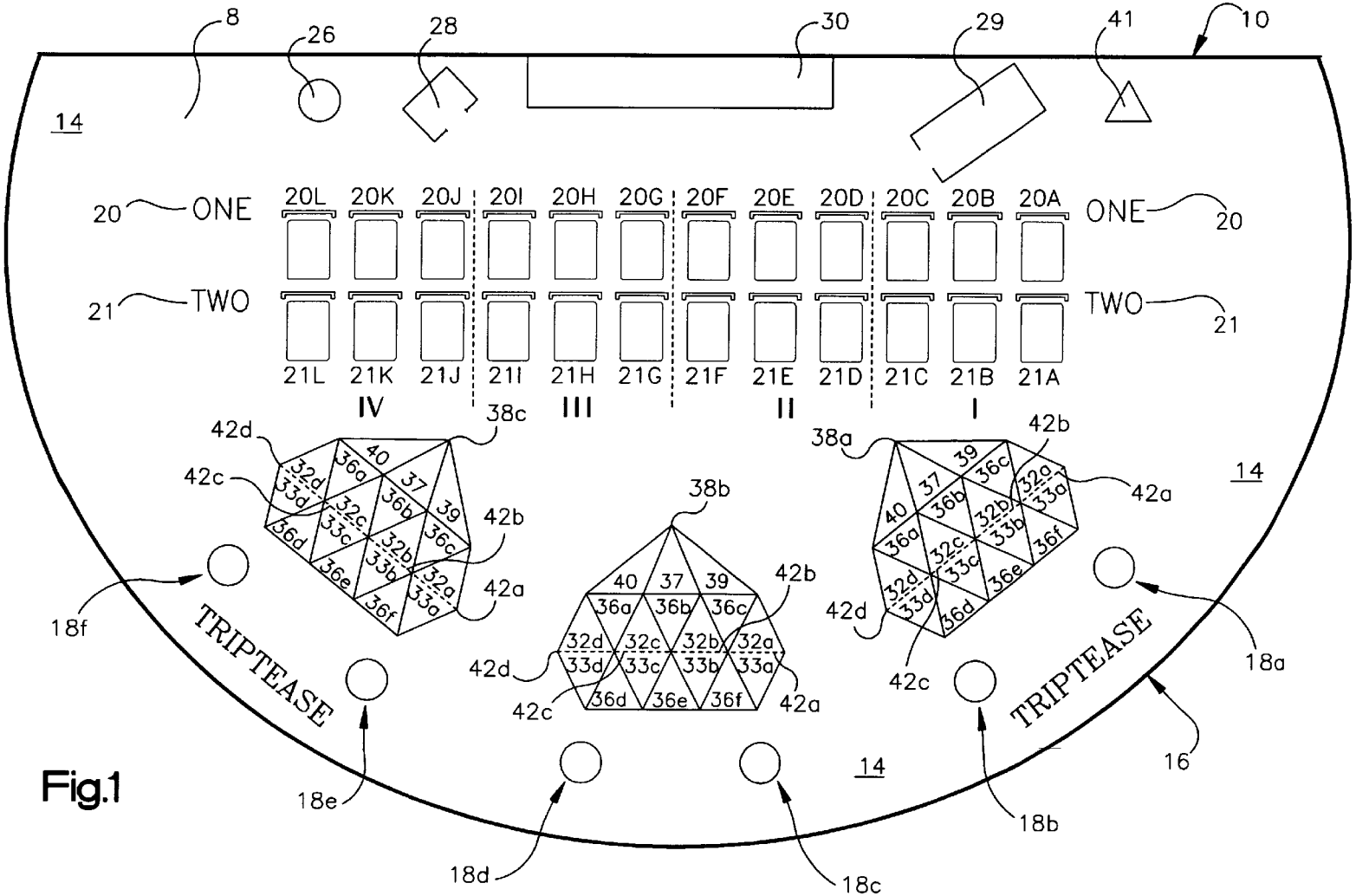
FIG. 1 depicts a table top layout and apparatus used in playing a wagering game in accordance with an embodiment of the present invention.

Referring to FIG. 1, an apparatus for a wagering game in accordance with the present invention includes a typical casino gaming, half sphere in geometric shape table 8. The table 8 has a flat surface 14 covered with cloth, felt or other appropriate material. The table 8 has a curved side 16 for accommodating up to six players and a straight side 10 for accommodating the dealer. Although six player positions or locations 18*a–f* are provided, it is not essential to the present invention that exactly six persons play. For professional or casino play a maximum of six players provides for a game that is easily manageable by the dealer. A house dealer position 30 along with including an area suitable for displaying both the Player-one 20, and the Player-two 21 display card areas cards is provided. Unique areas to the present invention are Common Betting Areas CBAs 38*a–c*. CBAs are designed to receive appropriate wagering settling means such as coins or chips (not shown). Said three Common Betting Areas 38*a–c* are provided for the players positions 18*a–f,* with said CBA 38*a* being common to player positions 18*a–b,* said CBA 38*b* being common to player positions 18*c–d,* and said CBA 38*c* being common to player positions 18*e–f.* Each CBA 38*a–c* consists of twenty-one separate wagering areas comprising four Player-one roman zone wager areas 32*a–d* and four Player-two roman zone wager areas 33*a–d,* six Rank wager areas 36*a–f,* one distinct Tie wager area 37, four Quarter roman zone wager areas 42*a–d* comprising the four perforated horizontal lines that are separating 32*a–d* from 33*a–d,* and one Player-one zone wager area 39 and one Player-two zone wager area 40. These distinct CBAs, comprising Zones, Ranks and Tie wager areas are unique to the present invention by quantity and geometric shape, said shapes being of hourglass, diamond and/or triangular geometric design. Said diamond shape areas are segregated horizontally midway by a perforated line designating Quarter roman zone wager areas 42*a–d* and separating Player-one roman zone wager areas 32*a–d* from Player-two roman zone wager areas 33*a–d.* Rank wager areas are depicted with the capital lettered symbols of A,K,Q,J,T,N (See FIG. 3) and are located in each of the three CBAs 38*a–c.* Also unique to the present invention are that each zone wager area is common to other areas, i.e. Player-one roman zone wager area 32*a* is common to Quarter roman zone I 42*a,* along with distinct card positions 20*a–c.* Player-one roman zone wager area 32*b* is common to Quarter roman zone II 42*b,* along with distinct card positions 20*d–f.* Player-one roman zone wager area 32*c* is common to Quarter roman zone III 42*c,* along with distinct card positions 20*g–i.* Player-one roman zone wager area 32*d* is common to Quarter roman zone IV 42*d,* along with distinct card positions 20*j–l.* Player-two roman zone wager area 33 a is common to Quarter roman zone I 42*a,* along with distinct card positions 21*a–c.* Player-two roman zone wager area 33*b* is common to Quarter roman zone II 42*b,* along with distinct card positions 21*d–f.* Player-two roman zone wager area 33*c* is common to Quarter roman zone III 42*c,* along with distinct card positions 21*g–i.* Player-two roman zone wager area 33*d* is common to Quarter roman zone IV 42*d,* along with distinct card positions 21*j–l.* These unique Roman zone wager areas 32*a–d* and 33*a–d* are for players 18*a–f* to forecast and wager on the exact card position in the Player-one 20 and/or the Player-two 21 display card areas where a three of a kind match by rank will occur. Thus, for example, if a three of a kind match by rank occurs at Player-one display card area 20*f* then bets made at location 32*b* along with bets made on Quarter roman zone II 42*b* and bets made at 39 are winning bets; if a three of a kind match by rank occurs at location 21*f* then bets made at 33*b* along with bets made on Quarter roman zone II 42*b* and bets made at 40 are winning bets. Bets are coins or chips actually placed into the Common Betting Areas 38*a–c* on the gaming table top 14. A player wanting to wager or bet that a three of a kind match by rank will occur at location 20*h* and the three of a kind match by rank card will be a Queen, can place as desired separate bets at locations 32*c,* 36*c,* 42*c* and at location 40 in any of the CBAs 38*a–c.* These wager areas are provided for players at three Common Betting Areas 38*a–c* which give the players 18*a–f* the opportunity to bet in more than one area by providing the players the opportunity to place a wager in the areas of 32*a–d,* 33*a–d,* 36*a–f,* 39, 40, 42*a–d* and 37. Also available to the players is an opportunity to wager that no three of a kind match by rank will occur during a particular hand by placing the wager in area 37. Said hands are declared a Tie. All Tie hands consume or use a minimum of twenty-four cards, Player-one display card area 20 consuming twelve cards at locations 20*a–l* and Player-two display card area 21 consuming a total of twelve cards at locations 21*a–l.* All non-Tie related bets during a Tie hand are losing bets and all bets made at location 37 during a tie hand are winning bets. Payouts are made to the winning hands and the non winning hands are collected. An exemplary payout schedule or table in may be as follows:

| | | |
|---|---|---|
| Player-one zone | ONE | 1-1 even money |
| Player-two zone | TWO | 1-1 even money |
| Quarter roman zone | III, IV | 1-1 even money |
| Player-one roman zone | III, IV | 3-2 |
| Player-two roman zone | III, IV | 3-2 |
| Quarter roman zone | I, II | 3-2 |
| Player-one roman zone | I, II | 3-1 |
| Player-two roman zone | I, II | 3-1 |
| Player TIE zone | | 3-1 |
| Rank wagers A, K, Q, J, T, N | | 4-1 |

Both Player-one 20 and Player-two 21 display card areas are segregated into four equal sections (i.e., Quarter roman zone areas I, II, III and IV) by three perforated vertical lines. Said vertical lines are visually separating the Quarter roman zone areas I, II, III and IV. At one side of the dealer position 30, the apparatus for containing and dispensing the hand shuffled cards rests unmounted on the table top 14 and is commonly referred to as a card shoe 29. The card shoe 29 is of a typical open ended box for dispensing cards face down. Said shoe is loaded or filled with the hand shuffled cards by the dealer. At one side of the dealer position 30 is an apparatus for receiving the used cards which may be of a raised three wall type open ended box 28. Said apparatuses 8, 26, 28, 29 and 41 are provided by the house or casino.

Figure 2:
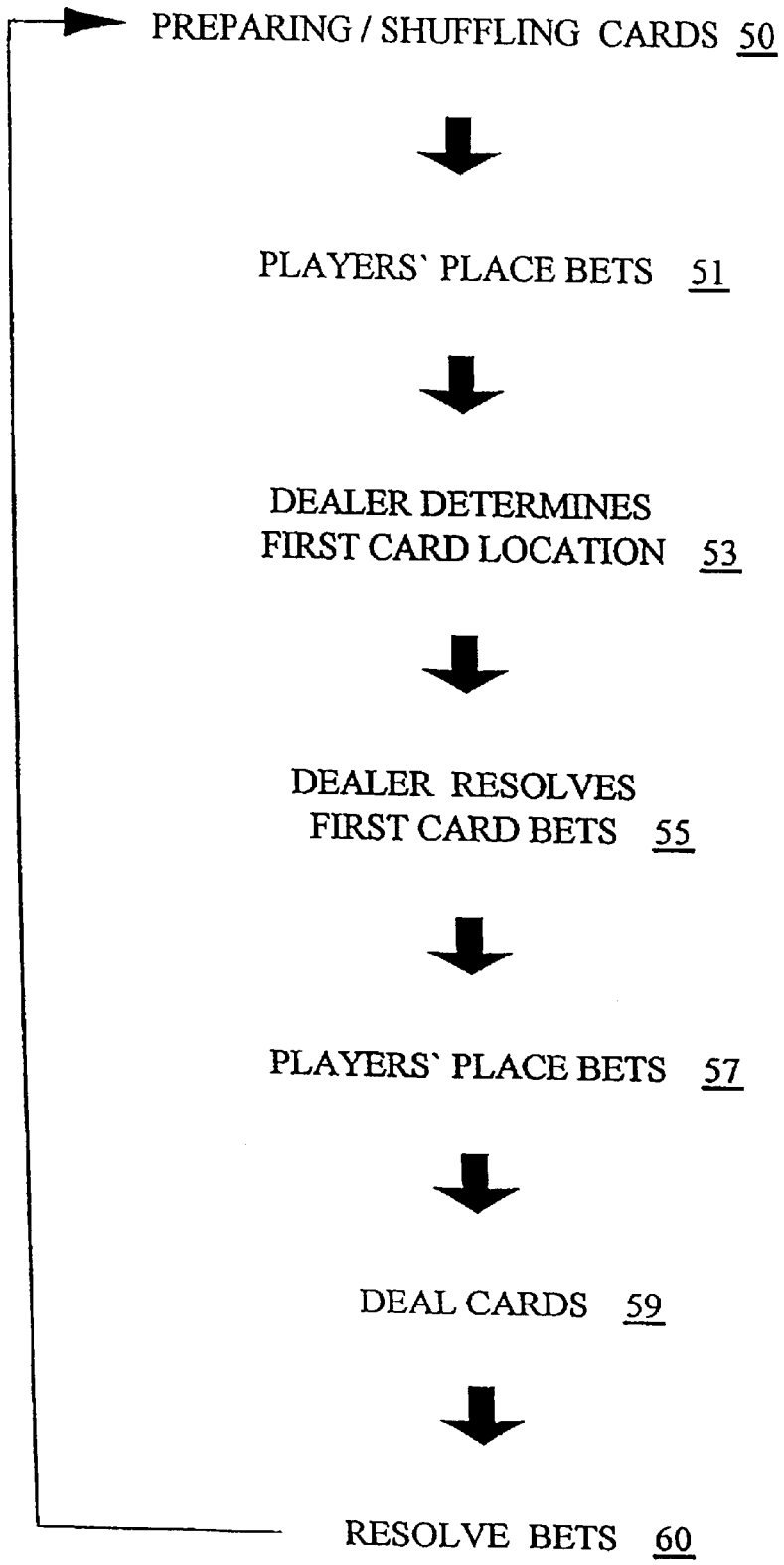
FIG. 2 is a Flow diagram representing the flow of play in said FIG. 1 game.

Referring to the Flow diagram of FIG. 2, the initial step of playing the game of the present invention is preparing or shuffling the cards Flow 50. Preferably used is the higher ranking portion of a typical fifty-two card deck of Poker playing cards or conglomeration of multiple said portions, said portion comprising the card ranks of ACE, KING, QUEEN, JACK, TEN and NINE. The cards are then loaded into the card shoe 29. Card ranks of Two through Eight may be discarded and need not be used in the present invention. Hand shuffling by the dealer is used for preparing said cards. The participating players place their initial wagers Flow 51. This wager is restricted to only Player-one 39 and Player-two 40 zone wager areas and is placed prior to any cards being dealt. The dealer 30 rolls a single die 26 to determine the location of where the first card will be dealt (either 20*a* or 21*a*) by the dealer Flow 53 (i.e., whether the first card will be dealt in 20*a* of the Player-one "ONE" display card area 20 or in 21*a* of the Player-two "TWO" display card area 21). The dealer indicates said first card location by placing a removable indicator apparatus 41, onto the depicted name ONE next to the display card area 20 or onto the depicted name TWO next to the display card areas 21. The dealer resolves each players initial wager 39, 40 Flow 55 by paying even money to the winning bets and collecting the losing bets. The dealer queries said players that they now can make up to twenty-one additional wagers Flow 57. Said wagers are made or placed into the Common Betting Areas 38*a–c* in front of that player position 18*a–f.* After the players are content with their wager decisions the bets stand, that is, they remain at risk and can not be further manipulated. The dealer prepares for Flow 59. At Flow 59, the dealer deals the cards face up to both the Player-one display card area 20 and to the Player-two display card area 21 in a typical staggered fashion starting with the card location designated by the first card indicator apparatus 41. Said fashion continues until a three of a kind match by rank occurs in any of the card positions a–l in either the Player-one display card area 20 or in the Player-two display card area 21. Said dealt cards are common to all three CBAs 38*a–c*. When a three of a kind match by rank occurs, i.e., AAA, KKK, QQQ, JJJ, TTT or NNN, the dealer 30 queries the participating players 18*a–f* of the three of a kind match and ceases dealing in preparation for Flow 60. If no three of a kind match by rank occurs then the hand is declared a TIE. A true TIE hand in the present invention occurs only when the Player-one 20 display card area and the Player-two 21 display card area have each received twelve face up cards (i.e., each distinct card position 20*a–l* has received a face up card and each distinct card position 21*a–l* has received a face up card) and neither of said areas 20, 21 offers a three of a kind match by rank. Participating players during Flow 57 are attempting to place wagers in the distinct areas 32*a–d,* 33*a–d,* 36*a–f,* 37, 39, 40, 42*a–d* in the Common Betting Areas 38*a–c* that correspond to Ranks, Ties, Zones or card locations a–l, in the Player-one display card area 20 or in the Player-two display card area 21 that said players forecast will be the exact card rank 36*a–f* and/or card position zone 32*a–d,* 33*a–d,* 39, 40, 42*a–d* that the third card of any three of a kind match by rank will occur or be dealt to said card positions 20*a–l,* 21*a–l* and/or said zones. Said players analyses is based on that individual players 18*a–f* strategic abilities and general gaming knowledge. Participating players can wager a minimum of one wager and a maximum number of wagers not to exceed twenty-one bets per hand. Two three of a kind matches by rank cannot occur in the present invention on the basis that the cards are not dealt beyond the first three of a kind match by rank occurring. Players prepare for Flow 60. At Flow 60 the dealer resolves each bet the participating players 18*a–f* wagered and determines what payout, if any, the said players are entitled to receive according to a payout schedule at that particular gaming table or casino. Bets on non winning hands are collected by the dealer or house 30. The hand is then over and the Flow of the game returns to Flow 51, players place bets. When cards are exhausted to an unplayable level, the Flow of the game then returns to Flow 50, preparing and shuffling cards.

Figure 3:
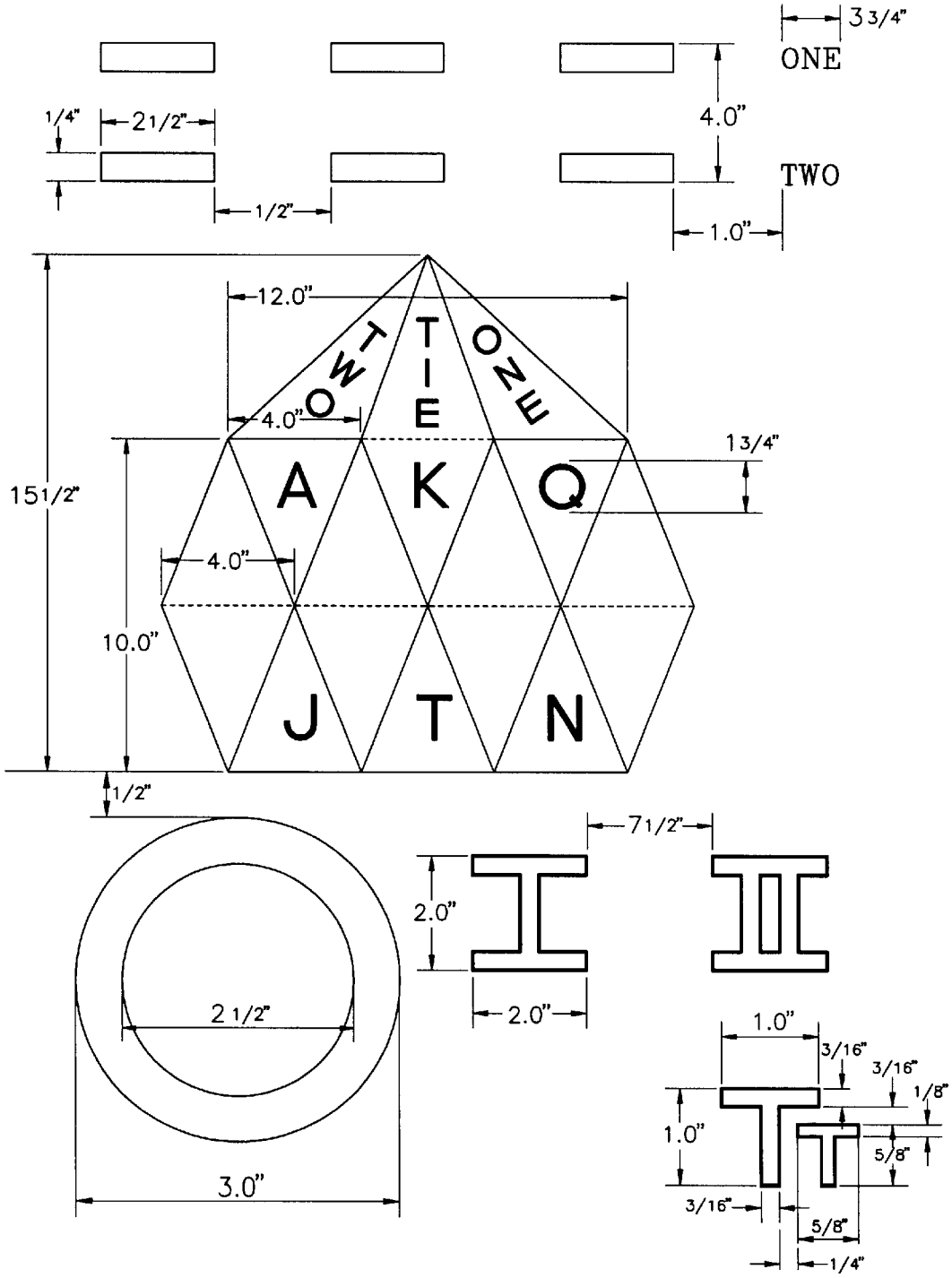
FIG. 3 depicts actual dimensions of specific areas on a gaming table top in accordance with the present invention and for use in said FIG. 1 game.

Referring to FIG. 3, this is a diagram wherein the table top positions for the players wagers, dealer display card areas, Common Betting Areas and the author of the present inventions abbreviated company name "TABLETOP TECHNOLOGY" (TT) are depicted in standard numerical measurement.

Figure 4:
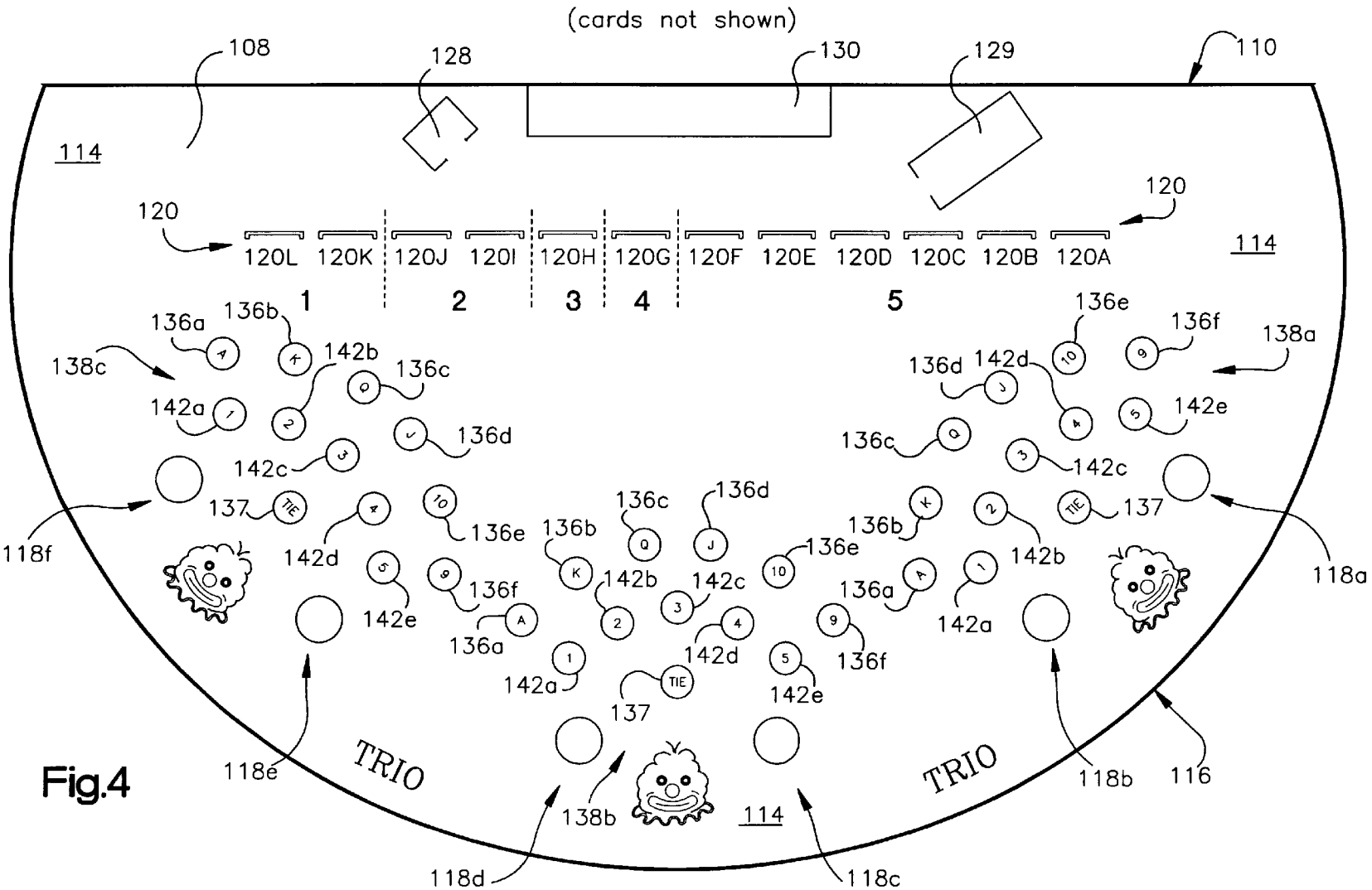
FIG. 4 depicts a table top layout and apparatus used in playing a wagering game in accordance with an embodiment of the present invention wherein cards are not shown.
Figure 5:
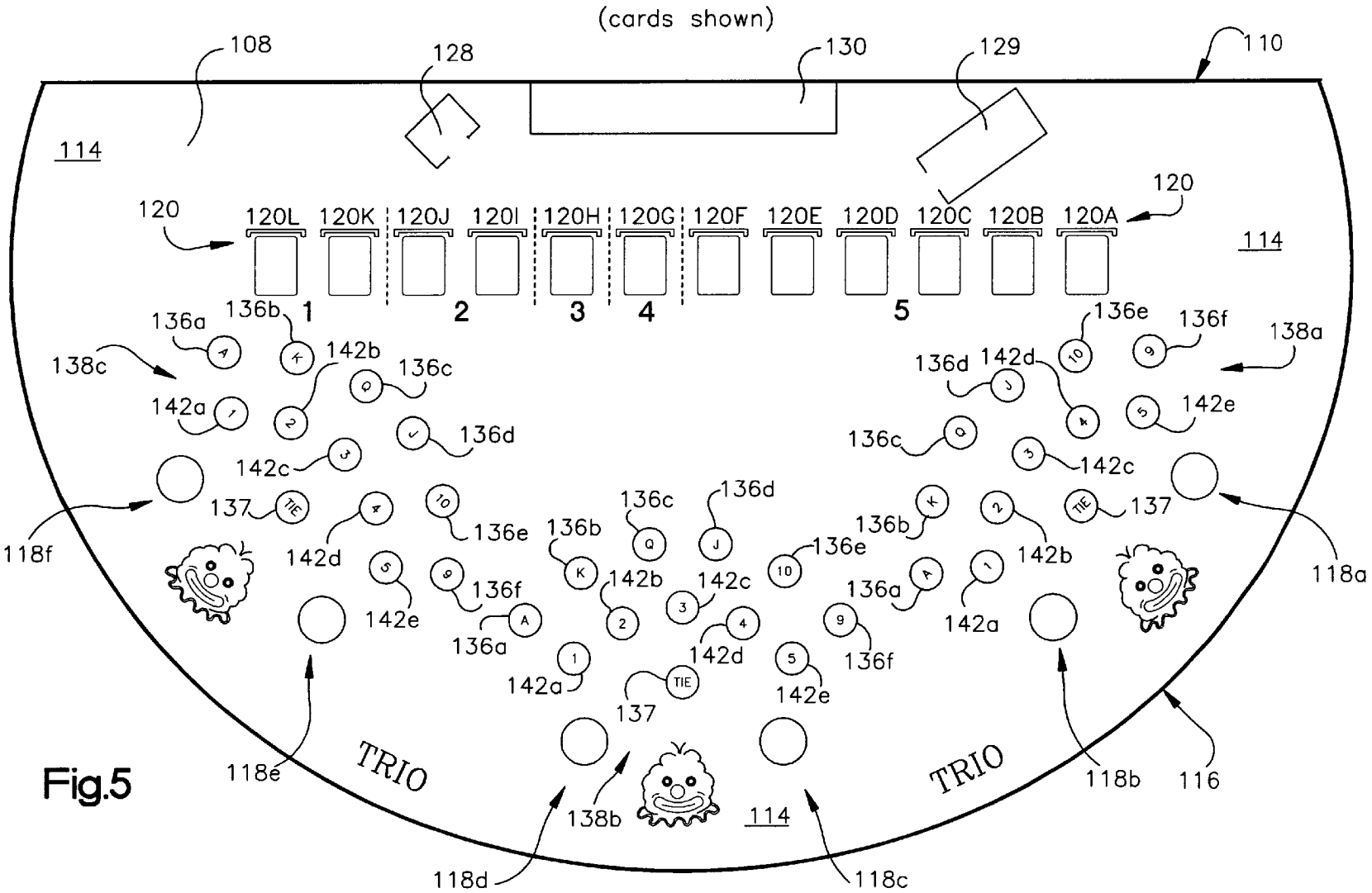
FIG. 5 depicts the table top layout and apparatus used in playing the wagering game depicted in FIG. 4 wherein cards are shown.

Referring now to FIGS. 4 and 5, an apparatus for a wagering game in accordance with another embodiment of the present invention includes a typical casino gambling or gaming table 108. FIG. 4 shows the table wherein cards are not shown and FIG. 5 shows the table wherein cards are shown. The table 108 has a flat surface 114 covered with cloth, felt or other appropriate material. The table 108 has a curved side 116 for accommodating up to six players and a straight side 110 for accommodating the dealer. Although six player positions or locations 118*a–f* are provided, it is not essential to the present invention that exactly six persons play and as many as fourteen players may participate. For casino play a maximum of six players provides for a game that easily manageable by the dealer and one in which the individual players feel more involved. A house dealer position 130 along with including an area 120 suitable for displaying the dealer display area cards 120*a–l* is provided. Unique areas to the present invention are Common Betting Areas, CBAs 138*a–c*. CBAs are designed to receive appropriate wagering indicators or settling means such as chips (not shown). Said three Common Betting Areas 138*a–c* are provided for the players positions 118*a–f,* with said CBA 138 a being common to player positions 118*a–b,* said CBA 138*b* being common to player positions 118*c–d,* and said CBA 138*c* being common to player positions 118*e–f*. Each CBA 138*a–c* consists of twelve separate wagering areas comprising six Rank wager areas 136*a–f,* one distinct Tie wager area 137, five Quint zone wager areas 142*a–e*. The Zone wager areas 142*a–e* are common to the distinct card position areas, which are separated therebetween with four vertical perforated lines that are separating 120*a–f* (distinct card position area 5) from 120*g* (distinct card position area 4), separating 120*g* from 120*h* (distinct card position area 3), separating 120*h* from 120*i–j* (distinct card position area 2) and separating 120*i–j* from 120*k–i* (distinct card position area 1). These distinct CBAs, comprising said Quint zones, Ranks and Tie wager areas are unique to the present invention by quantity and circular geometric shape, said shapes being arranged to imply floating balloons. Said arranged areas are organized and segregated by space. Rank wager areas 136*a–f* are depicted with the capital lettered symbols of A,K,Q,J,10,9 (see FIG. 7) and are located in each of the three CBAs 138*a–c*. Quint zone wager areas 142*a–e* are depicted by the numerical digits of 1,2,3,4,5, respectively, and the Tie wager area 137 is depicted by the actual word TIE. Also unique to the present invention are that each said Quint zone wager area is common to other areas, i.e., Quint zone wager area 142 a is common to distinct card position area 1, along with distinct card positions 120*k–i*. Quint zone wager area 142*b* is common to distinct card position area 2, along with distinct card positions 120*i–j*. Quint zone wager area 142*c* is common to distinct card position area 3, along with distinct card position 120*h*. Quint zone wager area 142*d* is common to distinct card position area 4, along with distinct card position 120*g,* and Quint zone wager area 142*e* is common to distinct card position area 5, along with distinct card positions 120*a–f*. These unique Quint zone wager areas 142*a–e* are for players 118*a–f* to forecast and wager on the exact card positions in the dealer display card area 120*a–l* where a three of a kind match by rank will occur. Thus, for example, if a three of a kind match by rank occurs at distinct card position 120*f* then bets made at location 142*e* are winning bets; or, if a three of a kind match by rank occurs at distinct card position 1201 then bets made at 142*a* are considered winning bets. Bets are coins or chips actually placed in the Common Betting Areas 138*a–c* on the gaming table top 114. A player wanting to wager or bet that a three of a kind match by rank will occur at location 120*h* and the three of a kind match by rank card will be a Queen can place as desired separate bets at locations 142*c* (which corresponds to the distinct card position area 3 and distinct card position 120*h*) and 136*c* (which corresponds to a card having a rank of Queen) in any of the CBAs 138*a–c*. These wager areas are provided for players at three Common Betting Areas 138*a–c* which give the players 118*a–f* the opportunity to bet or wager in more than one area by providing the players the opportunity to place a wager in the areas of 142*a–e,* 136*a–f* and area 137. Also available to the players is an opportunity to wager that no three of a kind match by rank will occur during a particular hand by placing the wager in area 137. Said hands are declared a Tie. All Tie hands consume or use a minimum of twelve cards, wherein the dealer display card area 120 will consume twelve face up cards at locations 120*a–l*. All non-Tie related bets during a Tie hand are losing bets and all bets made at location 137 during a tie hand are winning bets. Payouts are made to the winning hands and the non winning hands are collected by the dealer or house. An exemplary payout schedule or table may be as follows:

| | |
|---|---|
| Player TIE zone | 3-1 |
| Quint zone one (1) | 1-1 (even money |
| Quint zone two (2) | 1-1 (even money) |
| Quint zone three (3) | 1-1 (even money) |
| Quint zone four (4) | 1-1 (even money) |
| Quint zone five (5) | 1-1 (even money) |
| Rank areas A, K, Q, J, 10, 9 | 1-1 (even money) |

At one side of the dealer position 130, the apparatus for dispensing the cards is a card shoe 129. The card shoe 129 is of a typical open ended box for dispensing cards face down. Said shoe is loaded or filled with the hand shuffled cards by the dealer. At one side of the dealer position 130, is an apparatus for receiving the used cards and said may be of a raised three wall type open ended box 128.

Figure 6:
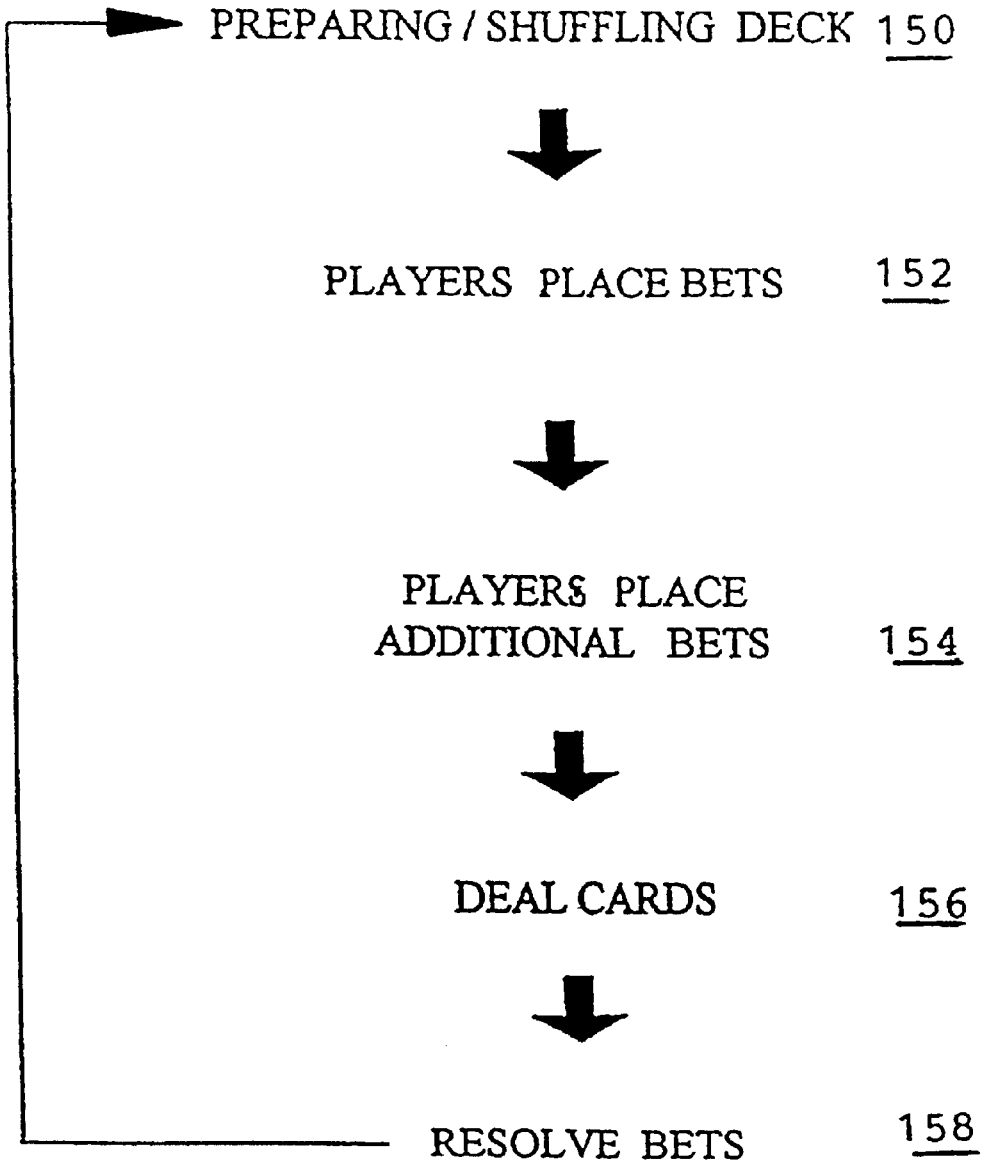
FIG. 6 is a Flow diagram representing the flow of play in said FIG. 4 game; and, FIG. 7 depicts actual dimensions of specific areas on a gaming table top in accordance with the present invention and for use in said FIG. 4 game.

Referring to the Flow diagram of FIG. 6, the initial step of playing the game of the present invention is preparing or shuffling the cards Flow 150. Preferably used is the higher ranking portion of a typical fifty-two card deck of Poker playing cards or conglomeration of multiple said portions, said portion comprising the card ranks of ACE, KING, QUEEN, JACK, TEN and NINE. Card ranks of Two through Eight may be discarded and need not be used in the present invention. Hand shuffling by the dealer is used for preparing said cards. The participating players place their initial wagers Flow 152. This wager is restricted to only the Rank wager areas 136*a–f*. The dealer queries said players that they now can make up to eleven additional wagers Flow 154. Said wagers are also made or placed into the Common Betting Areas 138*a–c* in front of that player position 118*a–f*. After the players are content with their wager decisions the bets stand, that is, they must remain at risk and cannot be further manipulated. The dealer prepares for Flow 156. At Flow 156, the dealer deals the cards face up into the dealer display card area 120 in a typical next after first fashion starting with the card location 120 a continuing towards location 120*l*. Said fashion continues until a three of a kind match by rank occurs in any of the card positions 120*a–l*. Said dealt cards are common to all three CRAs 138*a–c*. When a three of a kind match by rank occurs, i.e.. AAA, KKK, QQQ, JJJ, 101010 or 999, the dealer 130 queries the participating players 118*a–f* of the three of a kind match and ceases dealing in preparation for Flow 158. If no three of a kind match by rank occurs then the hand is declared a TIE. A true TIE hand in the present invention occurs only when all distinct card positions 120*a–l* each have received a face up card and the dealer display card area 120 still offers no three of a kind match by rank. Participating players during Flow 152 and Flow 154 are attempting to place wagers into the distinct areas in the Common Betting Areas 138*a–c* that correspond to Ranks 136*a–f*, Zones 142*a–e* or Ties 137 that said players forecast will be the exact card position 120*a–l* and or card rank 136*a–f* that the third card of any three of a kind match by rank will occur or be dealt to said card positions 120*a–l*. Said players 118*a–f* analyses is based on that individual players strategic abilities and general gaming knowledge. Participating players can wager a minimum of one wager and a maximum number of wagers not to exceed twelve bets. Two three of a kind matches by rank cannot occur in the present invention on the basis that the cards are not dealt beyond the first three of a kind match by rank occurring. Players prepare for Flow 158. At Flow 158 the dealer resolves each bet the participating players wagered and determines what payout, if any, the player is entitled to receive according to a payout schedule at that particular gaming table or casino. Bets on non winning hands are collected by the dealer or house 30. The hand is then over and the Flow of the game returns to Flow 152, players place bets. When cards are exhausted to an unplayable level, the Flow of the game then returns to Flow 150, preparing and shuffling the deck.

Figure 7:
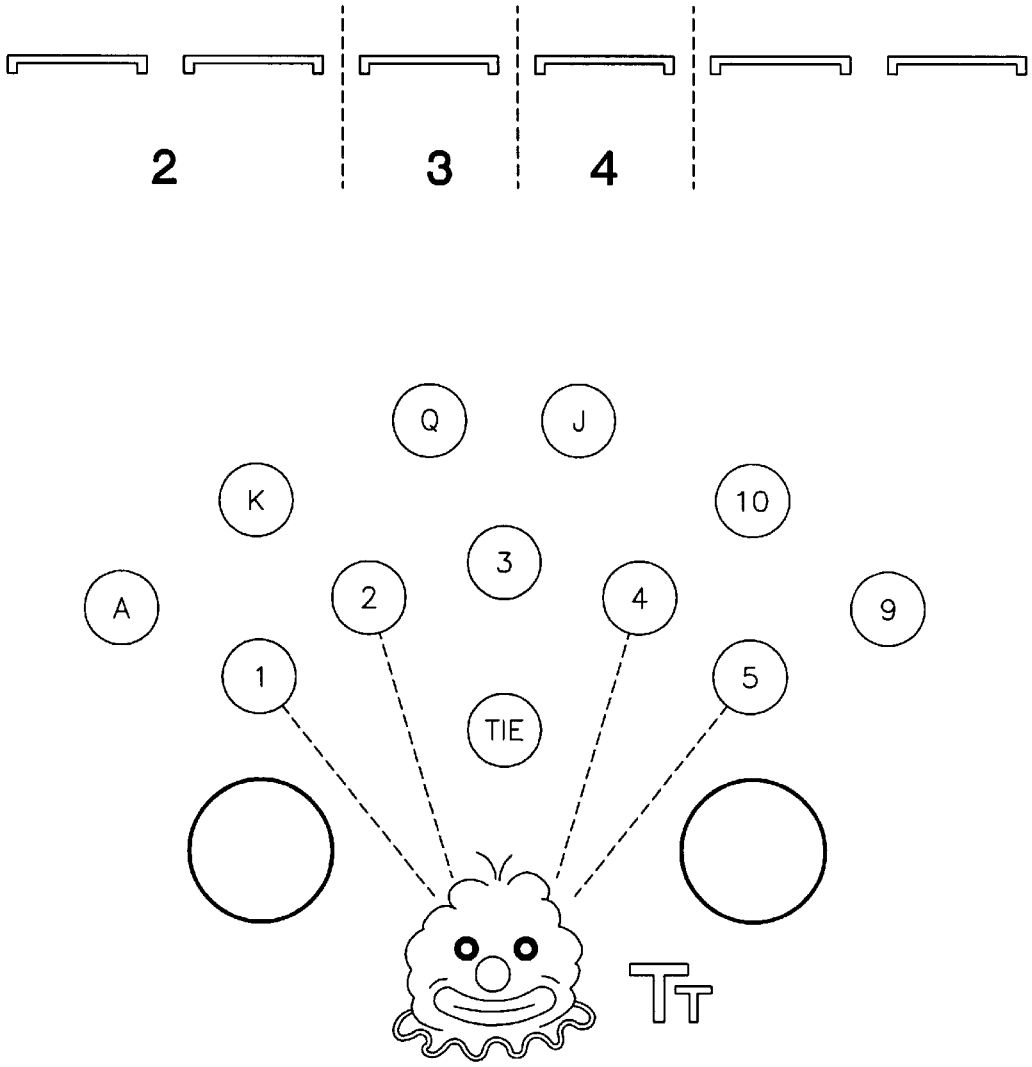

Referring to FIG. 7, this is a diagram wherein the table top positions for the players wagers, dealer display card areas, Common Betting Areas and the author of the present inventions abbreviated company name "TABLETOP TECHNOLOGY" (TT) are depicted in standard numerical measurement.

The method of the present invention does not require a shuffling machine as that disclosed in U.S. Pat. No. 4,807,884 for facilitating and speeding the play of the said wagering game, however, said apparatus would facilitate and expedite the play of the game as well as add interest to the game.

The method of the present invention is not limited to a three of a king match by rank. The number of cards to match by rank and constitute a winning hand is determined before dealing the cards. The present invention contemplates a two of a kind match by rank, or even a four of a kind match by rank, so long as the cards provided for the game can support the required match by rank. Thus, for example, so long as the playing cards provided for the game have two cards that match by rank, all other cards provided may be different in a two of a kind match by rank method of playing the present game. Similarly, so long as the playing cards provided for the game have four cards that match by rank, all other cards provided may be different in a four of a kind match by rank method of playing the game. Of course, if the non match by rank playing cards are all different from one another, then the plurality of playing cards provided for the game will constitute something other than a typical Pinochle playing card deck.

The method of the present invention is not limited to three card hierarchy games such as Guts or Showdown but may be applied or used as a variation of typical Poker games such as Five and Seven Card Stud, or an alternative to other appropriate games such as Baccarat. The wagering game of the present invention might be played live in casinos with a dealer or in casinos or homes in interactive electronic or video form with automatic coin or betting means receptacles and payout capabilities, wherein the appropriate symbols for cards, wagers or score keeping would be displayed electronically. "A board type game" suitable for home, club or casino use may also be provided for practicing the method of the present invention. The present invention may also be embodied in other specific forms without departing from the essential attributes thereof. It is desired that the embodiment described above may be considered in all respects as illustrative, and not restrictive, reference being made to the appended claims.

What is claimed is:

1. A method of playing a wagering card game for a number of players using the higher ranking portion of a typical fifty-two card Poker deck or a conglomeration of higher ranking portions, said cards having a standard rank, the method comprising the steps of:

providing a predetermined amount of display card area positions into which cards may be dealt;

each player placing an initial wager to participate in the game;

using a typical fair means method to cause a random start of game play;

resolving each players initial wager based on the typical fair means method;

giving each player the option to make additional wagers based on the player's forecast of at which display card area position a match by rank will occur;

dealing cards into the display card area positions until a match by rank or a Tie hand occurs; and resolving each players additional wagers based on whether the player correctly forecasted in which display card area position the dealt cards constitute the match by rank or whether the Tie hand occurred.

2. The method according to claim 1, wherein the initial wager is a location restricted wager.

3. The method according to claim 1, wherein the game method ends when the match by rank is a three of a kind match by rank or when there is a tie outcome.

4. A method of playing a wagering card game for a number of players using the higher ranking portion of a typical fifty-two card Poker deck or a conglomeration of higher ranking portions, said cards having a standard rank, the method comprising the steps of:

providing first and second display card areas into which cards may be dealt;

each player placing an initial wager to participate in the game;

using an outcome of a typical playing dice to start the game;

resolving each players initial wager based on the outcome of the typical playing dice;

giving each player the option to make additional wagers in first and second wager areas based on the player's forecast of at which display card area a match by rank will occur, wherein said first and second display card areas correspond to said first and second wager areas;

dealing cards to the first and second display card areas until a three of a kind match by rank or a Tie hand occurs; and resolving each players additional wagers based on which wager areas the respective player wagered in and on whether a three of a kind match by rank or a tie occurred.

5. A method of playing a wagering card game for a number of players using the higher ranking portion of a typical fifty-two card Poker deck, said portion comprising the card ranks of Nine through Ace, the method comprising the steps of:

providing a Player-one display card area having twelve display card area positions into which cards may be dealt and a Player-two display card area having twelve display card area positions into which cards may be dealt;

each player wagering an initial wager to participate in the game, said initial wager being placed at either a Player-one zone wager area corresponding to the Player-one display card area or at a Player-two zone wager area corresponding to the Player-two display card area in at least one common betting area;

using a playing die to start game play, wherein if the number rolled on said die is a two, four or six then a first card is dealt to a Player-two display card area, and if the number on said die is one, three or five, then the first card is dealt to a Player-one display card area;

resolving the initial wager of each player based on whether the player placed the initial wager in the Player-one or Player-two zone wager area and whether the first card dealt was in the Player-two or Player-one display card area;

giving the players the option to make up to twenty-one separate additional wagers in at least one common betting area in the at least one common betting area based on the player's forecast of at which display card area a match by rank will occur;

dealing additional cards not to exceed twenty-four cards in quantity to the Player-one display card area positions and to the Player-two display card area positions until a three of a kind match by rank or a Tie hand occurs in either said Player-one display card area or in said Player-two display card area; and resolving each players additional wagers based on the players said additional wagers made in the at least one common betting area and on whether the player correctly forecasted the display card area at which the three of a kind match by rank occurred or on whether a tie occurred.

6. The method according to claim 5, wherein the number of dealt cards needed for a Tie hand is greater by three than the maximum number of bets each player can place in the at least one common betting area.

7. The method according to claim 5, wherein the quantity of display card area positions is greater than the quantity of wagering areas in the at least one common betting area.

8. The method according to claim 5, wherein the number of same ranked cards needed for a winning match by rank is equal to the quantity of the at least one common betting areas.

9. The method according to claim 5, wherein the quantity of Player display card areas is equal to the quantity of players wagering opportunities.

10. An apparatus for playing the wagering game of claim 5, said apparatus including a playing surface having three common betting areas each diamond shaped in geometric design and each said common betting area comprising twenty-one areas for receiving up to twenty-one separate bets, two display card areas for receiving and displaying up to twelve cards each, and six player positions for accommodating the players.

11. A method of playing a wagering card game for a number of players using the higher ranking portion of a typical fifty-two card Poker deck or a conglomeration of higher ranking portions, said cards having a standard rank, the method comprising the steps of:

providing a predetermined amount of display card area positions into which cards may be dealt;

giving each player the option to make wagers based on the player's forecast of at which display card area position a match by rank will occur;

dealing cards to the display card area positions until a match by rank or a Tie hand occurs; and resolving each participating players wagers based on whether the player correctly forecasted the display card area position at which the dealt cards constitute the match by rank or whether the tie hand occurred.

12. The method according to claim 11, wherein the initial wager is a location restricted wager.

13. The method according to claim 11, wherein the game method ends when the match by rank is a three of a kind match by rank or when there is a tie outcome.

14. A method of playing a wagering card game for a number of players using the higher ranking portion of a typical fifty-two card Poker deck or a conglomeration of higher ranking portions, said cards having a standard rank, the method comprising the steps of:

each player placing an initial wager to participate in the game;

giving each player the option to make additional wagers in multiple wager areas corresponding to one or more of twelve display card area positions into which cards may be dealt, the player's additional wagers being based on the players forecast of at which of the twelve display card area positions a three of a kind match by rank will occur;

dealing cards to the display card area positions until a three of a kind match by rank or a Tie hand occurs; and resolving each players initial and additional wagers based on which wager areas the respective player wagered in and on whether a three of a kind match by rank or a tie hand occurred.

15. A method of playing a wagering card game for a number of players using the higher ranking cards of a typical fifty-two card Poker deck, said portion comprising the card ranks of Nine through Ace, the method comprising the steps of:

providing two display card areas into which cards may be dealt;

each player wagering an initial wager to participate in the game, said initial wager being placed at one or more rank wager areas in at least one common betting areas;

dealing a first card into one of the two display card areas;

resolving the players initial wagers based on the first card dealt;

giving the players the option to make up to eleven separate additional wagers in the at least one common betting area, the player's wagers being based on the players forecast of at which of the two display card areas a three of a kind match by rank will occur;

dealing cards not to exceed twelve cards in quantity to the display card areas until a three of a kind match by rank or a Tie hand occurs in one of said display card areas, and resolving each players wagers made in the at least one common betting area based on whether the player correctly forecasted the display card area at which the three of a kind match by rank occurred, or whether the tie hand occurred.

16. The method according to claim 15, wherein the number of dealt cards needed for a Tie hand is equal in quantity to the maximum number of wagers each player can place in the at least one common betting area.

17. The method according to claim 15, wherein the display card area is separated into one or more distinct card position areas and the quantity of distinct card position areas in the dealer display card area is less by seven than the quantity of wagering areas in the at least one common betting area.

18. The method according to claim 17, wherein each of the one or more distinct card position areas includes between one and six distinct card positions.

19. The method according to claim 18, wherein the quantity of distinct card positions in at least one of the one or more distinct card position areas is less by five than the quantity of the rank wager areas in the at least one common betting area.

20. The method according to claim 15, wherein the number of same ranked cards needed for a winning match by rank hand is equal to the quantity of common betting areas.

21. An apparatus for playing the wagering game of claim 15, said apparatus including a playing surface having three common betting areas each represented by a plurality of balloons and a clown in design and each said common betting area comprising twelve areas for receiving up to twelve separate bets, one display card area for receiving and displaying up to twelve cards and six player positions for accommodating the players.

22. A method of playing a wagering card game for a number of players, comprising the steps of:

providing a plurality of differently ranked cards, wherein at least two cards are of the same rank;

each player placing one or more wagers based on the player's forecast of when a match by rank will occur;

dealing a predetermined number of the plurality of differently ranked cards until a match by rank occurs whereby at least two cards have the same rank, or until a Tie hand occurs whereby after the predetermined number of the plurality of cards have been dealt no match by rank has occurred; and resolving each player's one or more wagers based on whether the player correctly forecasted when the dealt cards constitute the match by rank or whether the tie hand occurred.

* * * * *